United States Patent [19]

Fleissner

[11] 4,280,343

[45] Jul. 28, 1981

[54] APPARATUS FOR THE CONTINUOUS WET TREATMENT OF LIQUID-PERMEABLE TEXTILE MATERIAL OR THE LIKE

[75] Inventor: Hans Fleissner, Riehen, Switzerland

[73] Assignee: Vepa AG, Riehen, Switzerland

[21] Appl. No.: 116,209

[22] Filed: Jan. 28, 1980

[30] Foreign Application Priority Data

Jan. 27, 1979 [DE] Fed. Rep. of Germany ..... 2903125

[51] Int. Cl.[3] ..... D06B 5/08

[52] U.S. Cl. ..... 68/158; 68/184; 68/207; 68/DIG. 5

[58] Field of Search ..... 68/DIG. 5, 158, 184, 68/207

[56] References Cited

U.S. PATENT DOCUMENTS

| | | | |
|---|---|---|---|
| 2,288,949 | 7/1942 | Hinnekens | 68/158 |
| 3,864,948 | 2/1975 | Domoto | 68/DIG. 5 |
| 3,894,412 | 7/1975 | Fleissner | 68/DIG. 5 |

FOREIGN PATENT DOCUMENTS

| | | | |
|---|---|---|---|
| 2357055 | 5/1975 | Fed. Rep. of Germany | 68/DIG. 5 |
| 2734768 | 2/1979 | Fed. Rep. of Germany | 68/DIG. 5 |
| 94403 | 6/1959 | Norway | 68/158 |

*Primary Examiner*—Philip R. Coe

*Attorney, Agent, or Firm*—Craig and Antonelli

[57] ABSTRACT

An apparatus for the continuous wet treatment of liquid-permeable textile material includes a sieve drum located within a container that is filled with treatment liquid, with the drum being at least partially immersed within the liquid. A treatment chamber is formed between the sieve drum and one of the container walls and liquid is fed to this treatment chamber from a distributor duct located above the treatment chamber. The distributor duct includes a liquid discharge slot for feeding the liquid to the treatment chamber. A pump is provided for feeding liquid into the distributor duct and the liquid discharge slot is arranged to fed liquid uniformly across the operating width of the sieve drum.

5 Claims, 1 Drawing Figure

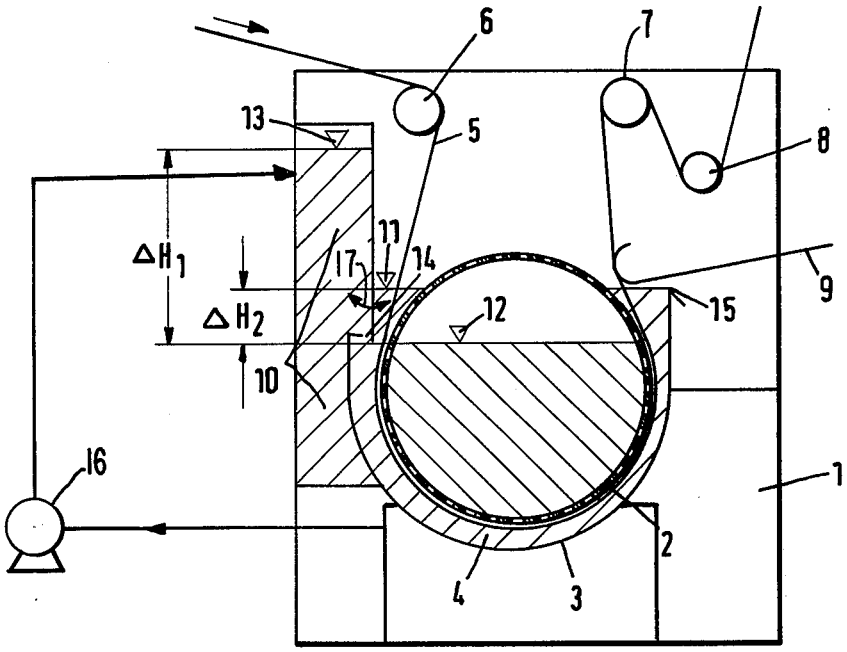
6
7
13
5
8
11
ΔH1
17
14
9
ΔH2
12
15
10
16
1
2
4
3

APPARATUS FOR THE CONTINUOUS WET TREATMENT OF LIQUID-PERMEABLE TEXTILE MATERIAL OR THE LIKE

The invention relates to an apparatus for the continuous wet treatment of liquid-permeable textile material or the like.

More particularly, this invention is directed to an apparatus comprising a sieve drum rotatably mounted in a container filled with a liquid, the sieve drum at least being partially immersed in the liquid, and partially being covered by the textile material from the outside, a treatment chamber being formed between this sieve drum and the container, the liquid being fed to this treatment chamber from the outside by way of a distributor duct open over the length of the sieve drum toward the treatment chamber and supplied with liquid by means of a pump, the liquid being discharged within the sieve drum, in such a way that a hydraulic pressure head effecting the throughflow is produced between the outside and the interior of the sieve drum, and at least at one location of the sieve drum the liquid is fed to the sieve drum with increased energy over the circumference covered by the material and by the liquid at right angles across the operating width.

An apparatus of a similar type is known from German Pat. No. 1,635,095. To supply the textile material resting on the sieve drum with the liquid necessary for the washing step, the liquid discharged from the interior of the sieve drum is pumped into a pipe in the apparatus of this patent, this pipe extending below the liquid level outside of the sieve drum transversely across the operating width. It is impossible with such a pipe to feed the liquid uniformly across the operating width of the drum. This holds true, in particular, for relatively large operating widths. It is also known from German Pat. No. 1,510,178 to feed the treatment medium to a permeable sieve drum alternatingly from the inside and from the outside of the sieve drum. Such an arrangement, likewise, proved to be unsuitable for increasing the washing effect, for the very fact that the textile material cannot be treated without tension in this procedure.

The washing effect with a sieve drum placed under an internal suction draft resides essentially in that the textile material is subjected to a throughflow of treatment liquor. In a washing operation to replace the dirty liquid volume present between the fibers, between the yarns in the woven fabric, by fresh water, a certain measure of energy is required. To overcome the resistance posed by the respective textile structure, a certain suction draft must be produced within the sieve drum, and, in the construction according to German Pat. No. 1,635,095 a certain pressure head is necessary between outside and inside the sieve drum. If this pressure head is insufficient to completely remove the dirt particles in the textile material, then a second, and in some cases a third sieve drum is required to effect the necessary washing of the textile material.

A problem in the washing step, wherein the liquid is to be guided through the textile material, is the peripheral surface of the sieve drum shell not covered by the textile material. In case of relatively small operating widths a rather large sieve drum area on the side remains uncovered by the textile material so that liquid drains off through this unused operating width without a washing action. This disadvantage can be mitigated by providing the sieve drum with a dual shell as known from DAS [German Published Application] No. 1,926,742.

In a sieve drum construction according to DAS No. 1,635,095, an essential advantage resides in that the liquid is discharged from the interior of the sieve drum uniformly over the operating width. This feature provides a uniform washing action over the surface area of even relatively wide textile materials. Since, as mentioned above, the throughflow to which the textile material is subjected for cleaning purposes depends on the difference value of the liquid level between the outside and the inside of the sieve drum, and this difference value, in turn, is affected by the uncovered drum surface area and by the permeability of the textile material, this pressure head cannot be manipulated. The arrangement of nozzles extending over the operating width is advantageous insofar as the liquid is fed with increased energy, but the washing action over the operating width thus becomes nonuniform, for the liquid conducted through the nozzle tubes cannot exit uniformly across the operating width from the nozzle orifices when the liquid is fed from the end faces.

The invention is based on the object of providing the washing action and thus the throughflow effect at a sieve drum with a liquid fed from the outside, namely by means of a simple measure which does not have a negative influence on the advantageous features of the conventional sieve drum construction.

According to the invention, this object has been attained by providing that this liquid, fed at an increased feeding velocity, flows to the sieve drum uniformly across the operating width. This is possible by forming a liquid discharge slot oriented toward the sieve drum and having a constant cross section transversely across the operating width in the zone of the container wall, but in the proximity of the sieve drum, the liquid being supplied to this slot under uniform pressure over the length of the slot. The uniform feeding of the liquid is realized in an advantageous manner if a distributor tank or duct for receiving a liquid volume producing the hydraulic pressure head extends above the liquid discharge slot.

By means of the apparatus of this invention, it is now possible to increase, after all, the hydraulic pressure head between the outside and the inside of the sieve drum, which, heretofore, had been considered to be incapable of being influenced, and this can be done uniformly across the operating width so that the washing effect on a sieve drum and thus the throughflow quality exerted on the textile material can be enhanced.

The exit speed of the liquid from the slot is advantageously controlled by the aperture cross section of the slot in relationship to the hydraulic pressure head above the slot.

However, the pressure head is dependent merely on the design of the pump supplying the liquid to this distributor tank above the slot. Therefore, an essential advantage of this construction is that the feeding velocity of the liquid to the space outside of the sieve drum can be affected independently of the quality of the textile material and independently of the covering of the drum, and this can be done uniformly across the operating width. It will be understood that the pressure head is also dependent on the height of the liquid in the distributor tank that provides the pressure head.

The suggestion has been made in the older Application No. 27 34 768 to arrange the distributor duct at the level of the inlet for the material, and to effect the feeding of the liquid from this distributor duct along an overflow edge alongside the sieve drum. This measure has the advantage that the liquid fed to the treatment chamber outside of the sieve drum is supplied uniformly across the operating width. In this arrangement, not only the drainage but also the feed to the sieve drum are at an optimum. In a further development of this arrangement, the invention furthermore proposes to extend the walls of the distributor duct with a greater height and to produce the thus-formed liquid level at a higher point than the liquid level formed outside of the sieve drum. When realizing the purpose of this invention, the overflow edge is now to be constructed as a discharge slot.

In general, rotatably mounted guide rollers are provided above the container for the feeding and taking off of the textile material. To provide an optimum for the pressure head within the distributor duct, the walls of the duct should extend higher than the sieve drum, preferably up into the level of the guide rollers. In this way the liquid can be fed, even at a relatively small pressure difference between the outside and the inside of the sieve drum, with a high pressure difference between the liquid level within the distributor duct and within the sieve drum, uniformly to this sieve drum across the operating width. Just as in case of a dam, the liquid provided in the distributor duct, dammed up to a considerably high level and having an energy potential, is converted in the outlet slot into kinetic energy. Due to this flow velocity, the textile material is subjected even in the region of this nozzle slot to a stronger throughflow than resulting from the level difference between the outside and the inside of the sieve drum. Thus, a stronger bath circulation is obtained which has an advantageous effect also in the utilization of the heating energy fed by the heating units, by improving heat transfer.

The efflux direction and the amount of exiting liquid can be affected by the configuration of the slot. Therefore, this slot is suitably adjustable even during operation.

The drawing shows one embodiment of the sieve drum washing device of this invention in a cross-sectional view.

The sieve drum washing device consists of a container 1, wherein a sieve drum 2 is rotatably supported. The sieve drum 2 is surrounded by a container wall 3; between the wall and the sieve drum 2, a treatment chamber 4 is formed. It will be understood that the ends of the chamber are closed off by the external walls of container 1. The container wall 3 has a U-shape so that the treatment chamber 4 extends with a narrow cross section and approximately annularly around the sieve drum 2. However, the sieve drum 2 is arranged eccentrically to the center of the container wall 3 in such a way that the channel of the treatment chamber 4 is narrowed toward the outlet 15. Thereby an increased liquid pressure is produced on the outlet side of the treatment chamber.

The sieve drum 2 is encompassed from the outside partially by a textile material 5 which is supplied and taken off, respectively, by way of guide rollers 6, 7 arranged above the sieve drum 2 at a spacing to the drum. A dancer roll 8 to control the take-off speed and a stripper plate 9 are shown at the outlet; the stripper plate is arranged above the overflow 15 extending along the sieve drum 2.

The textile material 5 to be washed on the sieve drum 2 is subjected to a throughflow of a liquid conveyed into the treatment chamber 4 by means of a pump, not shown, this liquid then flowing into the interior of the sieve drum 2. For this purpose, the liquid which has entered the interior of the sieve drum is removed by suction at one of the end faces or provision is made for means for allowing the liquid to flow off from the sieve drum at the end face. Since the level 12 within the sieve drum 2 is provided at a lower height than the level 11 outside of the sieve drum 2, a hydraulic pressure head $\Delta H_2$ is produced. This height difference between the thus-produced liquid levels 11, 12 is dependent on the open sieve drum surface laterally of the textile material 5 and on the liquid permeability of the textile material to be treated. This pressure head $\Delta H_2$ thus cannot be affected mechanically.

In the zone of the inlet for the material, a distributor duct 10 is arranged in parallel to the sieve drum 2; the liquid drained from the interior of the sieve drum 2 is fed to this distributor duct by means of a pump 16 for uniform distribution into the treatment chamber 4. The distributor duct 10 extends not only up to the height of the level 11 outside of the sieve drum 2, but even extends therebeyond to approximately below the entering textile material 5 or up to the height of the guide roller 6. On account of the power of the pump, a liquid level height 13 is produced in the distributor duct 10 which is considerably higher than the level 11 produced outside of the sieve drum.

According to the embodiment, a discharge slot 14 is formed at the distributor duct 10 in the zone of the sieve drum 2 below the level 11; this slot extends with constant cross section in parallel to the sieve drum 2. This liquid discharge slot 14 represents a nozzle gap, via which the liquid dammed up in the distributor duct 10 flows under excess pressure to the sieve drum 2 completely uniformly across the operating width. The pressure head $\Delta H_1$ between the liquid level 13 in distributor duct 10 and the level 12 within the sieve drum 2 is dependent solely on the design of the pump and on the slot cross section, i.e. the throttle point at the distributor duct 10. Consequently, the exit speed of the liquid from the slot 14 can be predetermined, namely independently of the textile goods to be washed and the operating width of such goods.

The advantage of this construction resides in ensuring a uniform efflux of the treatment liquid with uniform pressure and in uniform amount over the length of the slot 14. Depending on the orientation and size of the slot 14, an advantageous intensification of the washing process on the sieve drum 2 can be produced without being able to exert any influence on the pressure head $\Delta H_2$.

The slot width and orientation of the slot with respect to the sieve drum are adjustable as shown by the red arrows 17.

What is claimed is:

1. An apparatus for the continuous wet treament of liquid-permeable textile material or the like which comprises a container provided with a container wall and filled with a treatment liquid, a sieve drum rotatably mounted in said container, the drum being at least partially immersed in the liquid, and being partially covered by the textile material on the outside peripheral surface thereof, a treatment chamber being formed between said sieve drum and the container wall, a distributor duct open over the length of the sieve drum, a pump means for supplying liquid to said distributor duct, the liquid being fed to said treatment chamber from the outside via the distributor duct, means for ensuring that the liquid is discharged from within the sieve drum, whereby a hydraulic pressure head effecting the throughflow is produced between the inside and the outside of the sieve drum, and said distributor duct including a liquid discharge slot for feeding the liquid to the outside of the sieve drum with increased energy over the peripheral surface covered by the textile material and by the liquid transversely across the operating width, thereby feeding the liquid uniformly across the operating width of the sieve drum; said liquid discharge slot having a constant cross-sectional area, being oriented towards the sieve drum and being formed transversely across the operating width and in the proximity of the sieve drum, and said liquid being fed to said slot under uniform pressure across the length of the slot with the distributor duct extending above the liquid discharge slot and receiving a liquid volume that produces a hydraulic pressure head.

2. An apparatus according to claim 1, wherein the exit velocity of the liquid from the slot is controlled by its cross-sectional area in relationship to the hydraulic pressure head above the slot.

3. An apparatus according to claim 1, wherein said distributor duct has walls extending at a greater height and having a liquid level being higher than the liquid level in the treatment chamber outside of the sieve drum.

4. An apparatus according to claim 3 further comprising guide rollers rotatably mounted above the container for the feeding and taking off of the textile material, the walls of the distributor duct extending higher than the sieve drum up to the height of the guide rollers.

5. An apparatus according to claim 1, wherein the slot width and orientation of the slot with respect to the sieve drum are adjustable.

* * * * *